US007125255B2

(12) United States Patent
Queen

(10) Patent No.: US 7,125,255 B2
(45) Date of Patent: Oct. 24, 2006

(54) PUZZLE

(76) Inventor: Larry C. Queen, 5400 Catmint Ct., Holly Springs, NC (US) 27540

( * ) Notice: Subject to any disclaimer, the term of this patent is extended or adjusted under 35 U.S.C. 154(b) by 255 days.

(21) Appl. No.: 10/707,829

(22) Filed: Jan. 15, 2004

(65) Prior Publication Data

US 2005/0156379 A1 Jul. 21, 2005

(51) Int. Cl.
*G09B 19/00* (2006.01)

(52) U.S. Cl. ..... 434/156; 273/153 R

(58) Field of Classification Search ..... 434/128, 434/156, 171, 177, 178; 272/153 R
See application file for complete search history.

(56) References Cited

U.S. PATENT DOCUMENTS

| | | | | |
|---|---|---|---|---|
| 1,542,148 | A | | 6/1925 | Kramariuk |
| 3,728,800 | A | | 4/1973 | Magram |
| 3,813,841 | A | | 6/1974 | Tsurumi |
| 3,836,150 | A | | 9/1974 | Forgrave |
| 4,044,476 | A | | 8/1977 | Marsh |
| 4,299,578 | A | * | 11/1981 | Wayman ..... 434/177 |
| 4,360,347 | A | | 11/1982 | Ghaznavi |
| 4,361,328 | A | | 11/1982 | Stein et al. |
| 4,613,309 | A | | 9/1986 | McCloskey |
| 4,676,762 | A | | 6/1987 | Ballard |
| 4,690,410 | A | | 9/1987 | Berton |
| 4,880,238 | A | | 11/1989 | Derouin |
| 4,950,165 | A | | 8/1990 | Machaalani |
| 5,040,797 | A | | 8/1991 | Dykstra |
| 5,282,631 | A | * | 2/1994 | Baker ..... 273/272 |
| 5,337,501 | A | | 8/1994 | Amanze |
| 5,554,062 | A | | 9/1996 | Goldsen |
| 5,685,120 | A | | 11/1997 | Sihra |
| 5,702,105 | A | | 12/1997 | Glikmann |
| 5,799,943 | A | | 9/1998 | Morgan |
| 6,146,232 | A | | 11/2000 | Robbins |
| 6,511,073 | B1 | | 1/2003 | Simonds |

* cited by examiner

*Primary Examiner*—Kurt Fernstrom
(74) *Attorney, Agent, or Firm*—Moore & Van Allen PLLC; Michael G. Johnston

(57) ABSTRACT

A puzzle comprising a plurality of pieces wherein each piece comprises an elongated member having a longitudinal axis, a first surface and an opposite second surface. A plurality of symbols are longitudinally spaced along the first surface or the second surface. Engaging means are also disposed on at least one of the first and second surfaces, and associated with at least one of the symbols. The pieces connect to one another at the engaging means associated with symbols which share a common characteristic.

34 Claims, 5 Drawing Sheets

PUZZLE

BACKGROUND OF INVENTION

This invention relates generally to puzzles, and more particularly to flat sheet puzzles wherein individual pieces of the puzzle interfit with one another in a crossword type pattern.

A typical crossword type pattern puzzle includes a plurality of individual pieces in the form of rectangular blocks, which are assembled using interlocking tabs, grooves, notches, and the like to form a flat pattern. Correct placement of the pieces of the puzzle is accomplished by matching distinctive indicia among the commonly connected pieces. Many of the known puzzles are assembled in one particular configuration wherein all of the pieces interlock in a single predetermined pattern to form a single puzzle solution.

SUMMARY OF INVENTION

According to the present invention, a piece is provided for a puzzle. The puzzle piece comprises an elongated member having a longitudinal axis, a first surface and an opposite second surface. A plurality of symbols are longitudinally spaced along the first surface or the second surface. Engaging means are also disposed on at least one of the first and second surfaces, the engaging means associated with at least one of the symbols.

Also according to the present invention, a puzzle comprising a plurality of pieces is provided. Each piece comprises an elongated member having a longitudinal axis, a first surface and an opposite second surface. A plurality of symbols are longitudinally spaced along the first surface or the second surface. Engaging means are also disposed on at least one of the first and second surfaces, the engaging means associated with at least one of the symbols. The pieces connect to one another at the engaging means associated with symbols which share a common characteristic.

BRIEF DESCRIPTION OF DRAWINGS

For a more complete understanding of the present invention, reference should now be had to the embodiments shown in the accompanying drawings and described below. In the drawings.

DETAILED DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
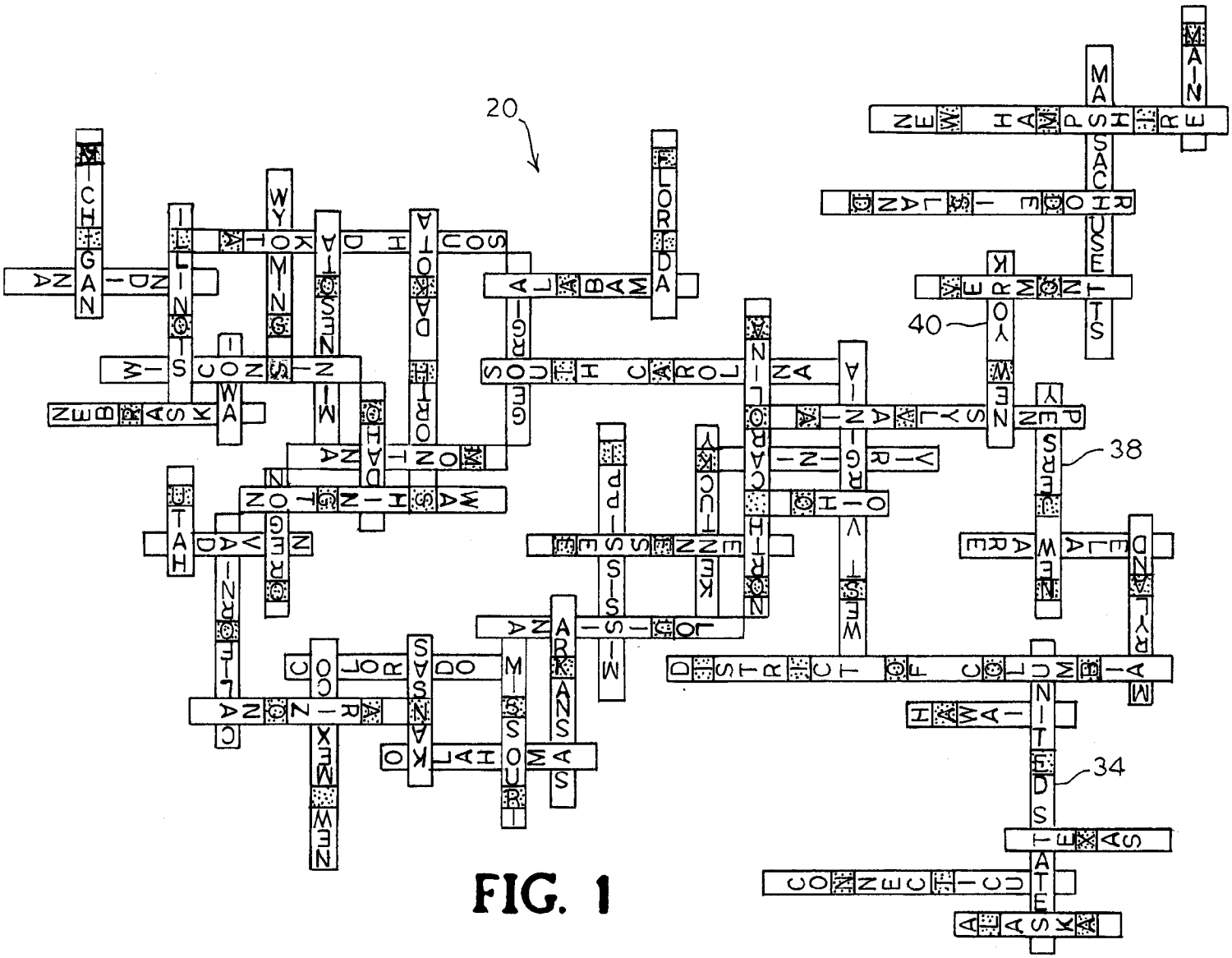
FIG. 1 is a perspective view of a completed puzzle according to the present invention.

Referring now to the drawings, wherein like reference numerals designate corresponding or similar elements throughout the several views, a puzzle according to the present invention is shown in FIG. 1 and generally designated at 20. The puzzle 20 includes a plurality of pieces 22 comprising elongated members, or building elements, which are connected together in a flat crossword type pattern.

Representative pieces 22 of the puzzle 20 are shown in FIGS. 2–8, which depict substantially rectangular solids. Each piece 22 has an upper longitudinal face 24, a lower longitudinal face 26 and rectangular end faces 28. The upper face 24 and lower face 26 are interconnected by identically-sized rectangular side faces 30 perpendicular to the upper and lower faces. The upper and lower faces 24, 26 are dimensioned so that the piece 22 is free standing in a stable manner on either the upper face 24 or the lower face 26. It is understood that the shape of the puzzle pieces 22 shown in the FIGS. represents only one embodiment of the present invention and that pieces 22 having different shapes may be used. Thus, the shape of the pieces 22 need not be rectangular, but may be square, hexagonal, pentagonal, triangular, or any other shape which allows an interlocking relationship between related puzzle pieces. Further, the pieces 22 can be substantially flat within the scope of the present invention.

The puzzle pieces 22 can be made from any suitable material, which may include wood, fiberboard, cardboard, metal, ceramic and the like. The puzzle pieces 22 may also be molded from suitable plastic materials, such as ABS, acrylic plastic, polystyrene, or polypropylene. Other synthetic materials may also be used, such as rubber foam, polyurethane, and the like. The puzzle pieces 22 can also be made of, or include magnetic material that can attach to a moving or stationary metallic surface. A thinner, flatter puzzle piece 22 is also possible, which would allow the use of woven and non-woven fabric, paper products, and the like for forming the puzzle pieces 22. Given the many possibilities for the material of construction, it is understood that the scope of my invention is not intended to be limited by the materials listed here, but may be carried out using any material which allows the construction of the puzzle pieces 22 and use of the puzzle 20 described herein.

According to the present invention, the puzzle pieces 22 are provided with symbols 32, or combinations of symbols, longitudinally spaced along at least one of the upper face 24 or lower face 26 of each piece 22. The symbols 32 may be a graphic symbol, such as a character representing a letter of the alphabet or number (an alphanumeric character), complimentary marks, tokens, signs, flags, pictures, and the like. The symbols 32 can also be colors or shades of colors.

The symbols 32 may be applied to the upper face 24 or lower face 26 of the puzzle pieces 22 by printing, stamping, stenciling or other similar means. Alternatively, the symbols 32 can be marked on paper, or similar material, and the paper applied to the puzzle pieces 22 using adhesive. If plastic or other moldable material is used to form the puzzle pieces 22, the symbols 32 may be molded onto the pieces. The symbols 32 may be impressed or raised. The latter adapts the puzzle 20 for use by blind persons since they would be able to feel the raised individual symbols 32.

In keeping with the present invention, the symbols 32 are chosen so that all of the pieces 22 of the puzzle 20 share a common characteristic or relate to a common subject. In one embodiment, the symbols 32 are letters of the alphabet, and the letters comprise a word or words which relate to a common subject. For example, the common subject can be a geographic location, such as a continent, a country, or a state, and the word on each puzzle piece 22 is a name of a geographic portion of the location, such as countries of the continent, states or provinces of the country, or counties of the state, respectively. One example of this embodiment of the present invention is shown in the FIGS., wherein the common geographic subject of the puzzle 20 is the United States, and the letters on each piece 22 spell state names. In this embodiment, each piece 22 of the puzzle 20 has different lengths depending on the number of letters in a word. The puzzle 20 may also include a piece identifying the common subject of the puzzle 20. This is shown in the example in FIG. 1 wherein one piece 34 includes letters which spell UNITED STATES.

It is understood that the common subject of the puzzle 20 may relate to other than geographic locations, as long as the pieces 22 share the common subject or a common characteristic. Moreover, if the symbols 32 are letters of the alphabet and the letters comprise words, the subjects of the puzzle 20 are virtually limitless. A few examples includes puzzles whose common subject is actors and actresses, quotes and familiar sayings, political figures, foreign words, animals, flowers, trees, monuments, and the like. Other subjects for the symbols include, but are not limited to, mathematical propositions, chemical formula for equations, Morse code, the periodic table of elements, National Parks, lighthouses, etc.

Figure 9:
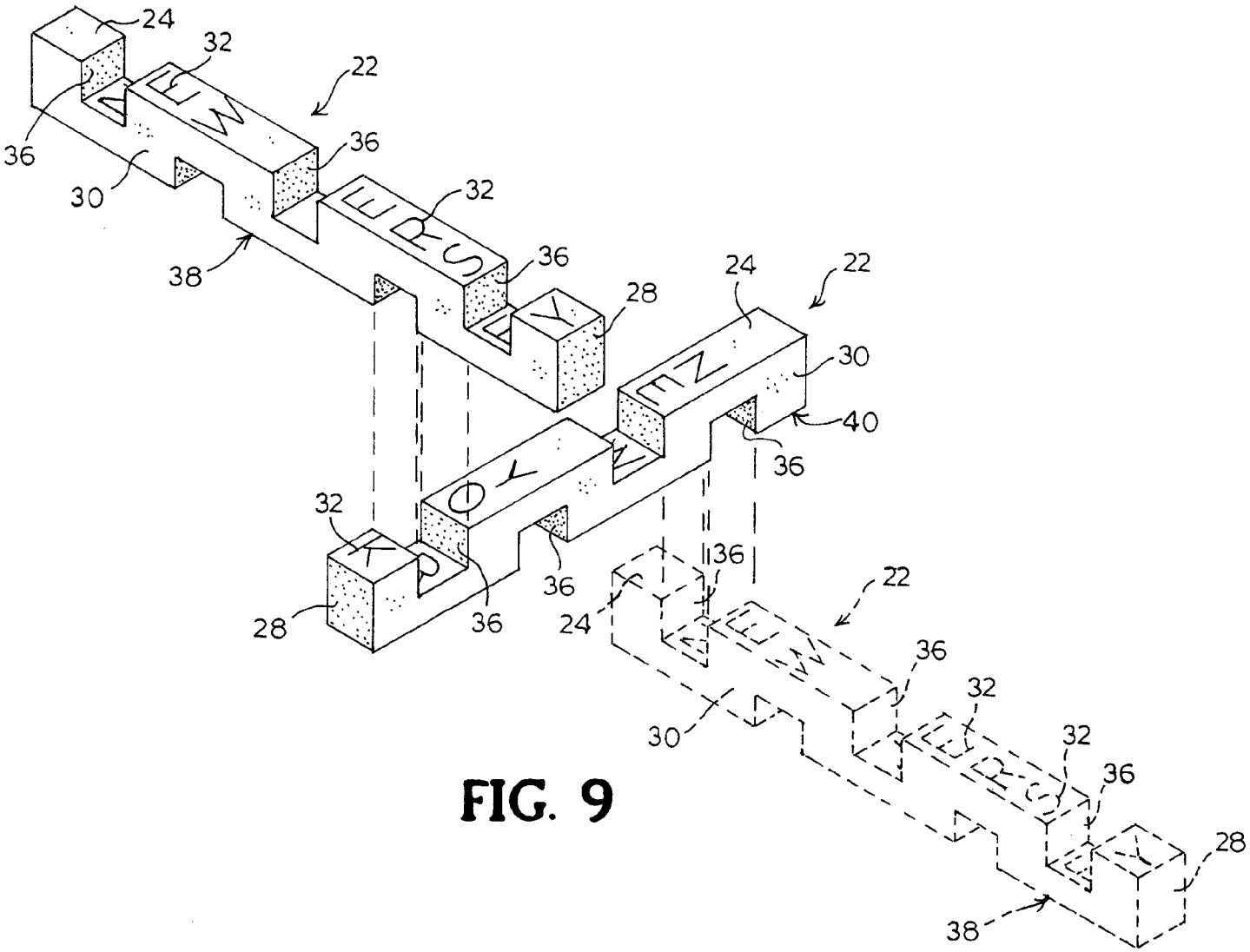
FIG. 9 is an exploded view of two pieces of the puzzle shown in FIG. 1 with an alternative connecting position shown in phantom.

The pieces 22 of the puzzle 20 are provided with engaging means for connecting the individual pieces 22 of the puzzle 20 to one another. In the embodiment of the present invention shown in the FIGS., wherein the puzzle pieces 22 are rectangular blocks (FIGS. 2–8), the engaging means comprises notches 36 extending inwardly from each of the upper face 24 and lower face 26 of the pieces 22. Each notch 36 is rectangular in cross-section and may have a depth equal to at least one-half the height of the block. As seen in FIG. 9, the notches 36 are shaped to allow the pieces 22 to connect to one another when arranged face-to-face in a mutually perpendicular relationship. The length of the notches 36 is slightly greater than the width of the piece 22 to allow the pieces 22 to slidingly fit together. With this configuration, the joined pieces 22 generally retain their relative positions. All of the edges on the block-shaped pieces 22 are shown as being rectilinear and at strictly right angles to the axis of the respective piece 22 on which they appear. It is understood that the various edges of the pieces 22 can be rounded or cambered. Further, the opposed, upwardly extending sidewalls of each notch 36 may be tapered to assist joining the pieces and facilitate their manufacture.

Engaging means are associated with at least one symbol 32 on either the upper face 24 or the lower face 26 of the puzzle pieces 22. Where two or more symbols 32 are on a face of the piece 22, engaging means may be associated with each symbol 32, or selected symbols 32 at spaced intervals along the length of the piece 22 such that the engaging means on a face of the piece 22 are separated by at least one symbol 32.

Figure 2:
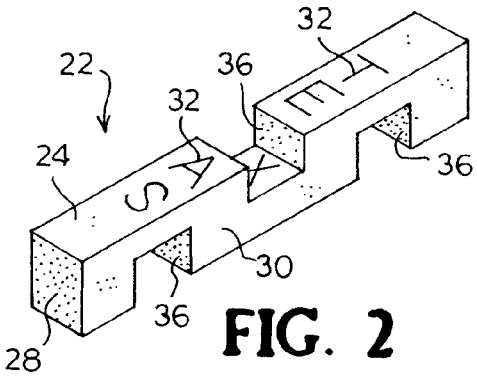
FIG. 2 is a perspective view of a piece of the puzzle shown in FIG. 1 with an odd number of symbols on the piece.
Figure 3:
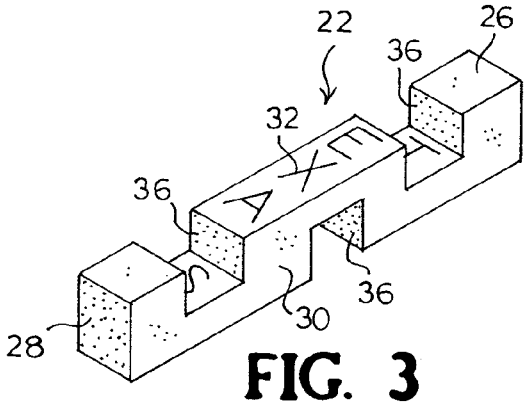
FIG. 3 is a perspective view of the opposite side of the puzzle piece shown in FIG. 2.
Figure 4:
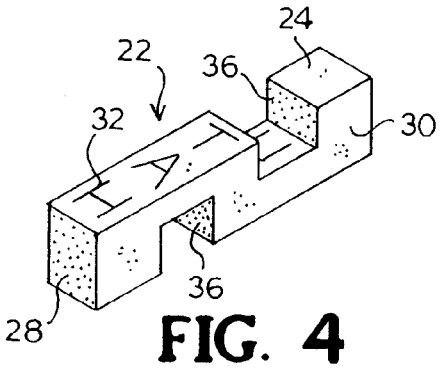
FIG. 4 is a perspective view of a piece of the puzzle shown in FIG. 1 with an even number of symbols on the piece.
Figure 5:
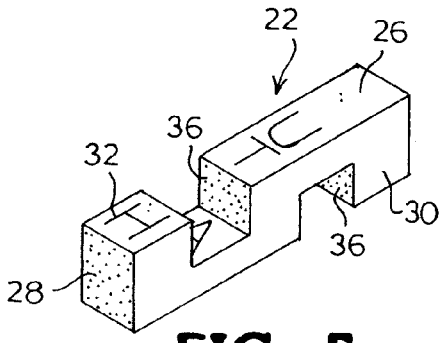
FIG. 5 is a perspective view of the opposite side of the puzzle piece shown in FIG. 4.

According to the embodiment of the present invention shown in the FIGS., each piece 22 of the puzzle 20 is divided into segments of equal length. Each symbol 32 corresponds to one of the segments. When letters which spell words are used as the symbols 32, a blank between words on a piece 22 is considered a symbol 32. A blank segment not having any symbol 32 is included as the first segment or the last segment on each piece 22. More specifically, when a word or words spelled by the symbols 32 on a piece 22 requires an odd number of symbols 32, a blank segment is provided as both the first and last segment on the piece 22. When a word or words spelled by the symbols 32 on a piece 22 requires an even number of symbols 32, a blank segment is provided as either the first or last segment on the piece 22. FIGS. 2 and 3 show a piece 22 with an odd number of symbols 32. The symbols 32 begin on the second segment of both the upper and lower faces 24, 26 of the piece 22, and the piece 22 starts and ends with a blank segment. When an even number of symbols 32 is used for a piece 22, the piece 22 may begin with a blank segment (FIGS. 4 and 5) and end with the last symbol 32 corresponding to the last segment of the piece 22. Alternatively, the first symbol 32 may correspond to the first segment of the piece 22 (FIGS. 6 and 7) and the piece 22 end with a blank segment. Thus, where n is equal to the number of symbols 32 on a piece 22, the length of a piece 22 in terms of segments according to this embodiment will be equal to (n+2) segments for a piece 22 with an odd number of symbols 32 and (n+1) segments for a piece 22 with an even number of symbols 32.

Figure 6:
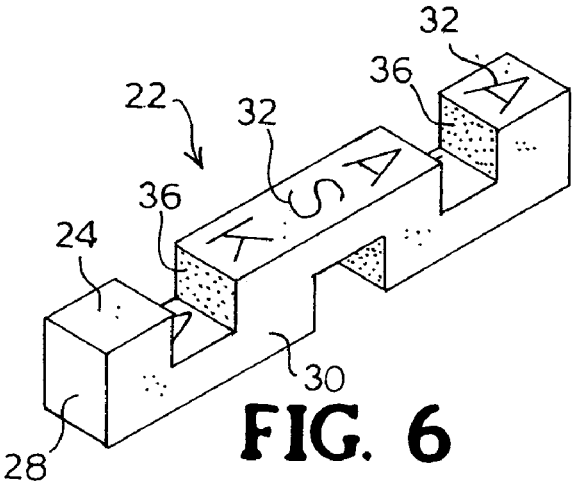
FIG. 6 is a perspective view of a piece of the puzzle shown in FIG. 1 with an even number of symbols on the piece.
Figure 7:
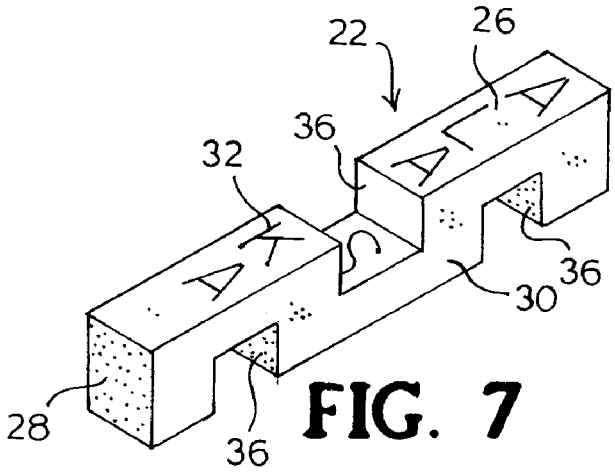
FIG. 7 is a perspective view of the opposite side of the puzzle piece shown in FIG. 6.
Figure 8:
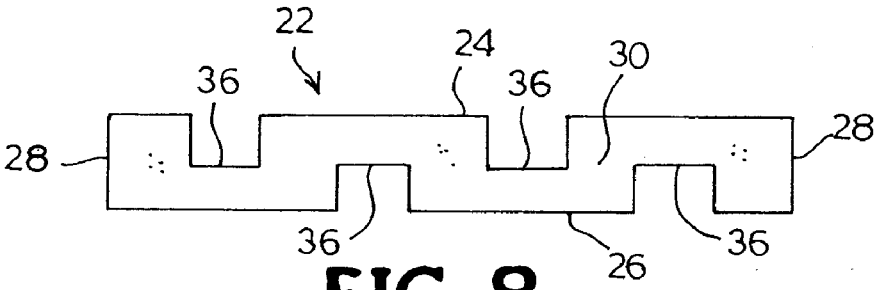
FIG. 8 is a side elevational view of a piece of the puzzle shown in FIG. 1 with an odd number of symbols on the piece.

Further according to this embodiment of the present invention, the length of each notch 36 is equal to one segment. Notches 36 will not be associated with the first or last segment. Moreover, since the depth of each notch 36 can be equal to one-half of the height of the piece 22, the notches 36 in the opposite faces 24, 26 must be formed no closer than every other segment. As best seen in FIGS. 2 and 6, with this arrangement, the spacing between consecutive notches 36 in opposite faces 24, 26 is one segment, represented by one symbol 32, and the spacing between consecutive notches 36 in the same face is three segments, represented by three symbols 32. For example, if engaging means is associated with the second segment on the upper face 24, engaging means would also be associated with the sixth, tenth, etc., segment in the upper face 24, and the fourth, eighth, twelfth, etc., segment in the lower face 26.

Any convenient flat work surface can be used to build the puzzle 20. To complete the puzzle 20 according to the present invention, a puzzler connects the pieces 22 based on a relationship between the pieces 22. An example of a connection point between two pieces 22 is a common symbol 32, with each symbol having an associated engaging means. In one embodiment, the symbols 32 on the pieces must also represent a shared common characteristic based on the common subject of the puzzle 20. The user thus manipulates the puzzle pieces 22 searching for common symbols 32 among pieces sharing this common characteristic and, when found, connects the pieces 22 in an interlocking arrangement with the pieces 22 joined at their respective engaging means associated with the common symbol 32. It is understood that the pieces 22 may be connected at more than one location if the pieces 22 share more than one common symbol 32. As seen in FIG. 9, and using the above example wherein the common subject of the puzzle 20 is the United States and the symbols 32 on the pieces 22 are letters spelling state names, the NEW JERSEY piece 38 may be connected to the NEW YORK piece 40 at the letters N, R or the letter W. If a common subject piece is used, that is, the UNITED STATES piece 34 (FIG. 1), the NEW JERSEY piece could be connected to the UNITED STATES piece at their common engaging symbol 32, at the letter E (not shown). Note that, although the NEW YORK piece 40 has the letter E, an engaging notch is not associated with that letter. Therefore, the NEW YORK piece 40 cannot be connected to any piece at the letter E.

Further, in the embodiment described above wherein the pieces 22 are rectangular solids and the engaging means are notches 36, the pieces 22 are connected by joining a notch 36 in an upper piece with a notch 36 in a lower piece (FIG. 9). Because the depth of the notches 36 is at least about one-half the height of the piece 22, the upper piece is lowered onto the other lower piece such that the upper piece reaches a position where further downward progress is impeded by the flat work surface. In this position, the walls defining the notches 36 extend along the sides of the respective transverse pieces 22 holding the puzzle pieces 22 in a perpendicular relationship and preventing disengagement of the pieces 22 other than by lifting the upper piece. Other shapes for the notches 36 are possible, as long as the shape of the pieces 22 and the notches 36 enable the pieces 22 to fit snugly together such that the pieces 22 are held in position relative to each other during assembly of the puzzle 20.

To solve the puzzle 20, the correlation of connected pieces 22 must be known to the puzzler. The puzzler may then assemble the puzzle 20 by either learning or assuming the connection point for joining the pieces 22 based on the symbols on the correlated pieces 22. However, as noted above, a piece 22 can potentially connect with another piece 22 at more than one point. Thus, the connection point is not mandated. In the embodiment shown in the FIGS., the arrangement of alternating notches 36 on the upper and lower faces 24, 26 of the pieces 22 allows manipulation of the choices and direction for joining the pieces 22. If correct connection points are chosen, the solution will be affirmed when all of the pieces 22 fit together in a crossword-type arrangement on the flat work surface and the puzzler's learning experience will be rewarded. However, a stage in assembling the puzzle pieces 22 may be reached where no further puzzle pieces 22 can connected while laying flat on the work surface. The puzzler must then at least partially disassemble an assembled portion of the puzzle 20 and rearrange the pieces 22. This process results in the puzzle 20 being worked several times. The puzzler also must be assured that all of the contiguous pieces are indeed complimentary, if necessary, with reference to an answer sheet or reviewed by an instructor. When the puzzle 20 is correctly assembled, the puzzler will have self-taught or self-reinforced the proper correlation between the complimentary pieces 22 of the puzzle 20. Moreover, because of the unique design of the puzzle 20 according to the present invention, there is more than one possible solution. Accordingly, there is no limit, other than the number of puzzle pieces 22 available, to the size of the crossword that can be formed. The more difficult solution is to assemble the pieces 22 such that the geometric area utilized by the completed puzzle 20 is minimized. Therefore, the scope of the invention is not intended to be limited to any particular orientation of the pieces 22.

An example solution of one embodiment of the puzzle 20 according to the present invention, wherein the common subject of the puzzle 20 is the United States and the symbols 32 on the pieces 22 are letters spelling state names, is shown in FIG. 1. The relationship between the pieces 22, or states, that must be known or learned by the puzzler to complete the puzzle 20 is the states which share a common border. If so, the pieces 22 are joined at a common letter of the states' names. Since most of the state names share more than one common letter, the pieces 22 may be connected at more than one location. Any of the pieces 22 may also be connected to the common subject piece, UNITED STATES 34 and, as such, all of the pieces 22 are connected directly or indirectly to the UNITED STATES piece 34. Thus, solving the puzzle 20 requires the puzzler to manipulate the pieces 22 searching for the appropriate connection points of bordering states that will allow all of the connected pieces 22 of the puzzle 20 to lay flat on the work surface. One of numerous solutions to the puzzle 20 based on these principles is depicted in FIG. 1.

In another embodiment of the present invention, a timer (not shown) may be used to provide an indication of the time lapsed in solving the puzzle 20, for example, for competitive puzzlers or to signify the completion of a pre-set time period. One example is a miniature music-generating device having a built in timer. The device is activated upon commencement of the working of the puzzle 20 and is played continuously for a set period, and the puzzler attempts to complete assembly of the puzzle 20 before the music stops.

The present invention provides an entertaining and educational puzzle useful for teaching memorization and recognition skills in a puzzler. Unlike totally interlocking puzzles, which may cause puzzlers to concentrate on solving the puzzle rather than learning the underlying lesson, the present invention is unique in that the puzzle 20 will accommodate and suggest different solutions, and thus will not restrict the puzzler to formulate only one correct construction. The puzzle 20 necessitates that the puzzler employ deductive reasoning in its construction.

Figure 10:
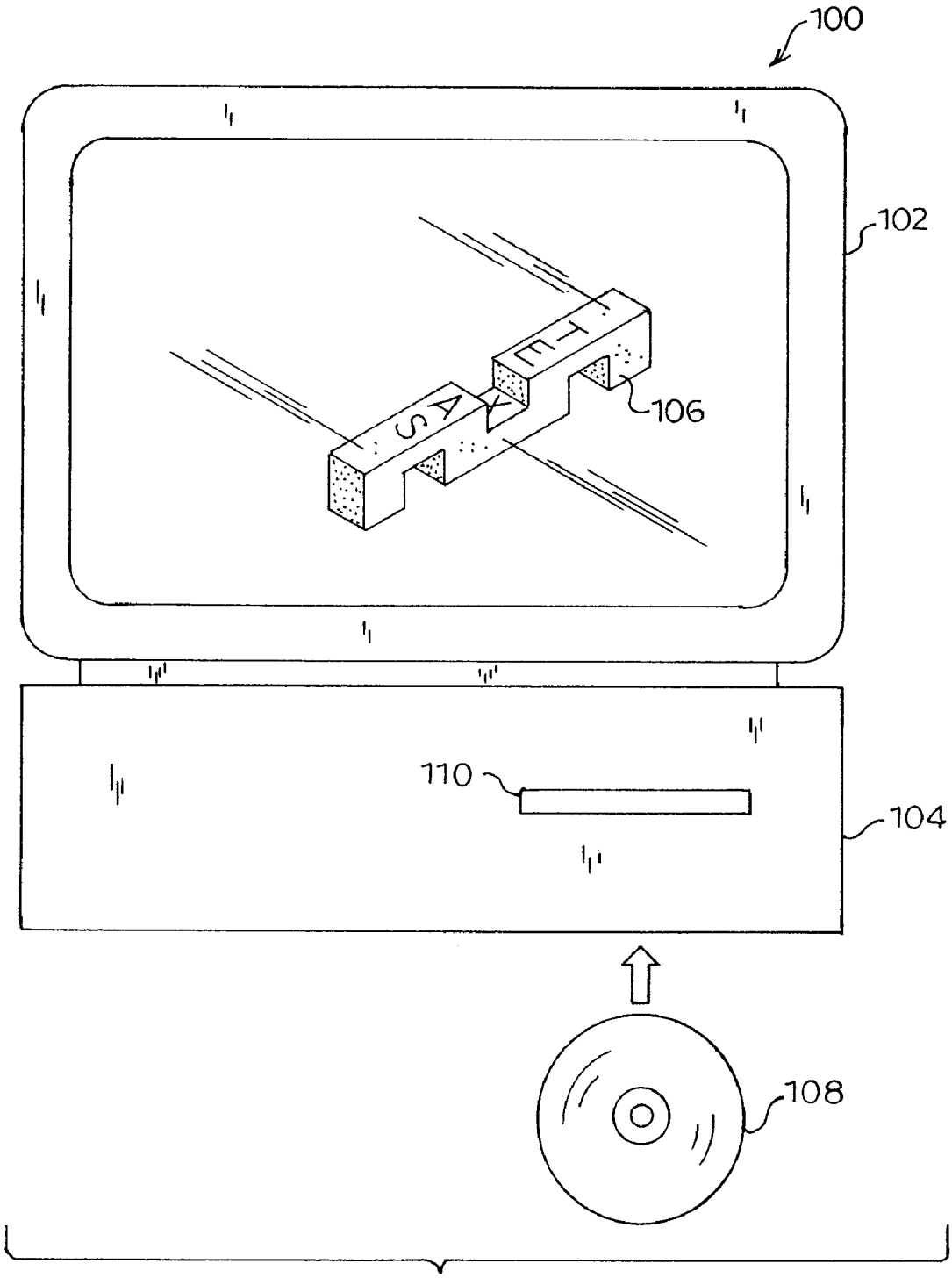
FIG. 10 shows how a piece of the puzzle can be rendered on a display screen if and when the puzzle is implemented by a computer system.

It should be noted that in addition to a physical manifestation of the puzzle and pieces, the invention as contemplated can include computerized or virtual manifestations in which the puzzle pieces are rendered on a computer display or video monitor, and the pieces can be manipulated by a user using an input device or input devices. In such cases a personal computer system, for example system 100 of FIG. 10, may be used to implement an embodiment of the invention. Such a system typically includes display 102, a keyboard (not shown), and a processing platform 104, which renders images, for example puzzle piece 106, on the display. The renderings may change, move, engage, disengage, etc. in response to user input via the keyboard, or another device such as a joystick or game pad. A game system, which is typically a specialized processing platform which uses a television or video monitor as a display can also be used. Also, it is understood that although the puzzle piece 106 is depicted as a rectangular solid, the visual manifestation of the piece 106 on the display 102 could appear one-dimensional.

In any of the above cases, it should be noted that a computer program product including computer software program instructions can control a processor to carry out embodiments of the invention. The computer programs can reside on any medium that can contain, store, communicate, propagate, or transport the program for use by or in connection with any type of computing platform or game system. Such a computer readable medium may be for example, but is not limited to, an electronic, magnetic, optical, electromagnetic, infrared, or semiconductor system or device, for example, CD-ROM 108, which can be loaded into computer system 100 via slot 110. Computer program instructions, which implement the invention, may also be embodied in a stream of information being retrieved over a network such as the Internet. Note that the computer usable or computer readable medium could even be paper or another suitable medium upon which the program is printed, as the program can be electronically captured via, for instance, an optical scan, then complied and interpreted, or otherwise processed in a suitable manner.

Although the present invention has been shown and described in considerable detail with respect to only a few exemplary embodiments thereof, it should be understood by those skilled in the art that I do not intend to limit the invention to the embodiments since various modifications, omissions and additions may be made to the disclosed embodiments without materially departing from the novel teachings and advantages of the invention, particularly in light of the foregoing teachings. For example, the engaging means could be on only one side of a puzzle piece. As discussed above, the puzzle pieces can be substantially flat in which case the engaging means for connecting the pieces, such as velcro, can be associated with the surface of the pieces. In addition, where symbols are placed on both sides of the puzzle pieces, opposed symbols can differ from one another. For example, the symbols on the one surface of a piece could be in reverse order with respect to the symbols on the other surface of the piece. Accordingly, I intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A piece for a puzzle, a plurality of which maybe used to solve the puzzle, the puzzle piece comprising:

an elongated member having a longitudinal axis, a first surface and an opposite second surface;

a plurality of symbols longitudinally spaced along to first surface or the second surface; and means for engaging disposed on at least one of the first and second surfaces, the engaging means associated with at least one of the symbols.

2. A puzzle piece as recited in claim 1, wherein the symbols are equally spaced along the surface.

3. A puzzle piece as recited in claim 1, wherein a plurality of the engaging means are longitudinally spaced along at least one of the first and second surfaces.

4. A puzzle piece as recited in claim 3, wherein the engaging means on one side of the piece are associated only with non-consecutive symbols.

5. A puzzle piece as recited in claim 1, wherein the symbols are letters of an alphabet.

6. A puzzle piece as recited in claim 5, wherein the letters spell a word.

7. A puzzle piece as recited in claim 1, wherein the elongated member is a rectilinear solid.

8. A puzzle piece as recited in claim 7, wherein the engaging means is a notch.

9. A puzzle piece as recited in claim 8, wherein the solid has a height and the notch has a depth equal to at least one-half the height.

10. A puzzle piece as recited in claim 1, wherein the number of symbols is odd.

11. A puzzle as recited in claim 1, wherein the number of symbols is even.

12. A puzzle piece as recited in claim 1, wherein a blank portion between symbols on the surface is a symbol.

13. A puzzle piece as recited in claim 8, wherein a notch associated with a symbol at either end of the piece is spaced from the respective end of the puzzle piece.

14. A puzzle piece as recited in claim 8, wherein the first surface has a first notch associated with a symbol adjacent to a first end of the piece and has a notch associated with every fourth symbol thereafter in a direction toward the second end, and the second surface has a first notch adjacent to the first end of the piece and associated with a symbol which is two symbols closer to the second end of the piece than a symbol on the second surface opposite the symbol associated with the first notch on the first surface, and the second surface having a notch associated with every fourth symbol after the first notch on the second surface in a direction toward the second end.

15. A puzzle, comprising:

a plurality of pieces, each piece comprising;

an elongated member having a longitudinal axis, a first surface and an opposite second surface, a plurality of symbols longitudinally spaced along the first surface or the second surface, and means for engaging disposed on at least one of the first and second surfaces, the engaging means associated with at least one of the symbols, wherein the pieces connect to one another at the engaging means associated with symbols which share a common characteristic.

16. A puzzle as recited in claim 15, wherein the engaging means associated with identical symbols on two separate pieces connect.

17. A puzzle recited in claim 15, further comprising a main puzzle piece which has a characteristic represented by the symbols that is common to all of the puzzle pieces, and to which all of the pieces of the puzzle may connect if any of the symbols associated with the engaging means on any of the pieces and the main piece also share a common characteristic.

18. A computer program product including a medium having a computer program thereon operable to render a piece for a puzzle, the piece being able to be manipulated through use of an input device to solve the puzzle, the computer program comprising:

instructions for rendering an elongated member having a longitudinal axis, a first surface and an opposite second surface;

instructions for rendering a plurality of symbols longitudinally spaced along the first surface or the second surface;

instructions for rendering means for engaging disposed on at least one of the first and second surfaces, the engaging means associated with at least one of the symbols.

19. A computer program product as recited in claim 18, wherein the symbols are equally spaced along the first and second surfaces.

20. A computer program product as recited in claim 18, further comprising instructions for rendering a plurality of the engaging means which are longitudinally spaced along at least one of the first and second surfaces.

21. A computer program product as recited in claim 20, wherein the engaging means on one side of the piece are associated only with non-consecutive symbols.

22. A computer program product as recited in claim 19, wherein the symbols are letters of an alphabet.

23. A computer program product as recited in claim 22, wherein the letters spell a word.

24. A computer program product as recited in claim 18, wherein the elongated member is a rectilinear solid.

25. A computer program product as recited in claim 24 wherein the engaging means is a notch.

26. A computer program product as recited in claim 25, wherein the solid has a height and the notch has a depth to at least one-half of the height.

27. A computer program product as recited in claim 18, wherein the number of symbols is odd.

28. A computer program product as recited in claim 18, wherein the number of symbols is even.

29. A computer program product as recited in claim 18, wherein a blank portion between symbols on the surface is a symbol.

30. A computer program product as recited in claim 25, wherein a notch associated with a symbol at either end of the piece is spaced from the respective end of the puzzle piece.

31. A computer program product as recited in claim 25, wherein the first surface has a first notch associated with a symbol adjacent to a first end of the piece and has a notch associated with every fourth symbol thereafter in a direction toward the second end, and the second surface has a first notch adjacent to the first end of the piece and associated with a symbol which is two symbols closer to the second end of the piece than a symbol on the second surface opposite the symbol associated with the first notch on the first surface, and the second surface having a notch associated with every fourth symbol after the first notch on the second surface in a direction toward the second end.

32. A computer program product including a medium having a computer program thereon operable to render a puzzle, the computer program comprising:

instructions for rendering a plurality of pieces, each piece comprising an elongated member having a longitudinal axis, a first surface and an opposite second surface, a plurality of symbols longitudinally spaced along the first surface or the second surface, and means for engaging disposed on at least one of the first and second surfaces, the engaging means associated with at least one of the symbols, wherein the pieces connect, in response to user input to one another at the engaging means associated with symbols which share a common characteristic.

33. A computer program product as recited in claim 32, wherein the engaging means associated with identical symbols on two separate pieces connect.

34. A computer program product as recited in claim 32, wherein the computer program further comprises instructions for rendering a main puzzle piece which has a characteristic represented by the symbols that is common to all of the puzzle pieces, and to which all of the pieces of the puzzle may connect if any of the symbols associated with the engaging means on any of the pieces and the main piece also share a common characteristic.

* * * * *

UNITED STATES PATENT AND TRADEMARK OFFICE

CERTIFICATE OF CORRECTION

PATENT NO. : 7,125,255 B2
APPLICATION NO. : 10/707829
DATED : October 24, 2006
INVENTOR(S) : Larry Queen It is certified that error appears in the above-identified patent and that said Letters Patent is hereby corrected as shown below:

Column 7
Line 47, change “maybe” to --may be--.
Line 51, change “to” to --the--.

Signed and Sealed this

Thirteenth Day of February, 2007

JON W. DUDAS
*Director of the United States Patent and Trademark Office*